US009227373B2

(12) United States Patent
Pettersson et al.

(10) Patent No.: US 9,227,373 B2
(45) Date of Patent: Jan. 5, 2016

(54) SYSTEMS AND METHODS FOR CREATING A MANUFACTURER'S JOINT AND CLOSING A BOX

(75) Inventors: Niklas Pettersson, Sandy, UT (US); Ryan Osterhout, West Haven, UT (US)

(73) Assignee: Packsize LLC, Salt Lake City, UT (US)

( * ) Notice: Subject to any disclaimer, the term of this patent is extended or adjusted under 35 U.S.C. 154(b) by 751 days.

(21) Appl. No.: 13/514,340

(22) PCT Filed: Dec. 13, 2010

(86) PCT No.: PCT/US2010/060131

§ 371 (c)(1), (2), (4) Date: Sep. 11, 2012

(87) PCT Pub. No.: WO2011/075445

PCT Pub. Date: Jun. 23, 2011

(65) Prior Publication Data

US 2012/0329627 A1 Dec. 27, 2012

Related U.S. Application Data

(60) Provisional application No. 61/286,254, filed on Dec. 14, 2009.

(51) Int. Cl.

| | |
|---|---|
| ***B31B 1/62*** | (2006.01) |
| ***B31B 13/02*** | (2006.01) |
| ***B31B 1/72*** | (2006.01) |

(52) U.S. Cl.

CPC ..... *B31B 1/72* (2013.01); *B31B 2201/29* (2013.01); *B31B 2201/6082* (2013.01); *B31B 2201/6086* (2013.01); *B31B 2203/066* (2013.01); *B31B 2203/082* (2013.01)

(58) Field of Classification Search

None

See application file for complete search history.

(56) References Cited

U.S. PATENT DOCUMENTS

| | | | | |
|---|---|---|---|---|
| 1,757,730 | A | 5/1930 | McPike | |
| 3,264,954 | A * | 8/1966 | Grobman | 493/59 |
| 6,363,690 | B1 * | 4/2002 | Lay et al. | 53/410 |
| 6,938,397 | B2 | 9/2005 | Miller | |
| 2006/0247113 | A1 | 11/2006 | Fox | |

FOREIGN PATENT DOCUMENTS

| | | |
|---|---|---|
| WO | 2011075445 | 6/2011 |

OTHER PUBLICATIONS

International Search Report and Written Opinion for PCT/US2010/060131 dated Feb. 11, 2011.

European Search Report for EP10838183 dated Jun. 22, 2015.

* cited by examiner

*Primary Examiner* — Hemant M Desai

*Assistant Examiner* — Tanzim Imam

(74) *Attorney, Agent, or Firm* — Workman Nydegger

(57) ABSTRACT

A system is disclosed for sealing a manufacturer's joint and/or the ends of a customized box. The system includes at least a first arm spaced apart from a second arm. The arms are arranged so that an end flap of a box blank can be inserted between the arms to align the box blank relative to the arms and secure and maintain at least two side panels of the box blank in an adjacent position to form a manufacturer's joint. Methods for forming and sealing a manufacturer's joint and/or the ends of a customized box are also disclosed. Such methods, are designed to, for example, reliably form, close, and seal the manufacturer's joint and/or the ends of a customized box in a simplified manner.

29 Claims, 9 Drawing Sheets

SYSTEMS AND METHODS FOR CREATING A MANUFACTURER'S JOINT AND CLOSING A BOX

This application claims priority to, and the benefit of, PCT Application Serial No. PCT/US2010/060131, filed on Dec. 13, 2010, and entitled "SYSTEMS AND METHODS FOR CREATING A MANUFACTURER'S JOINT AND CLOSING A BOX", which also claims priority to and the benefit of, U.S. Patent Application Ser. No. 61/286,254, filed on Dec. 14, 2009, and entitled "SYSTEMS AND METHODS FOR CREATING A MANUFACTURER'S JOINT, ERECTING, AND CLOSING A BOX", which applications are expressly incorporated herein by this reference in their entirety.

BACKGROUND

1. Technical Field

Exemplary embodiments of the invention relate to the manufacture and construction of packaging materials. More particularly, embodiments relate to systems, methods, and devices for creating a manufacturer's joint and sealing packaging materials, such as packaging formed of corrugated board.

2. The Relevant Technology

Manufacturers and suppliers of products often package their products in shipping containers before sending products to their customers. Each shipping container may accommodate either a single product or multiple products, depending on the application. Moreover, the container allows for ease in handling, shipping, and storing the products, along with providing protection from damage, theft, and contamination.

Although many types of shipping containers and container materials are readily available on the market, one of the most common shipping containers is a corrugated cardboard container or box. Boxes are typically both economical and sufficiently strong for most shipping uses and come in many shapes and sizes. Included in the known type of boxes to which the present invention can be applied is the regular slotted carton.

A regular slotted carton is generally rectangular and includes four contiguous vertical side surfaces and two pairs of flaps, commonly known as the major and minor pairs of flaps, on both the top and bottom of the box. Each of the flaps is connected to one of the vertical side surfaces, such that when the pairs of minor and major flaps are folded toward each other and toward the center of the box, the edges of at least the major flaps meet near the center of the top or bottom of the box, effectively creating the top and bottom horizontal surfaces of the box and closing the box. The flaps on the regular slotted carton are typically sealed in place by glue or by tape.

Numerous devices are used in the corrugated board industry to convert a cutout blank into a corrugated box. Some of these devices are able to cut, crease, and fold the corrugated blank so as to make the necessary creases and scores that allow for ready folding and erection of the box. A gluer is another device that is often grouped as one in a series of machines operating to convert paperboard blanks, one-by-one, into boxes. In one example, the gluer may be used to seal a manufacturer's joint, a glue flap, and the like in order to form a box. The manufacturer's joint is the portion of the box where the opposing ends of the box blank are attached together so that the four side-by-side panels create the four vertical contiguous walls of the box. The gluer ordinarily receives a folded blank with the four side-by-side panels separated from one another by longitudinal creases and slots.

As noted, each of the panels also includes opposing flaps that can be folded to form the top and bottom of the box. The gluer may apply glue to an adhesive strip or prepare an adhesive strip to seal the manufacturer's joint, thereby creating a box with four connected sides. Alternatively, the gluer may apply glue to a glue tab and/or an opposing panel and press the glue tab against the opposing panel, thereby creating a box with four connected sides.

Typical gluers are relatively large, complex machines. These machines often have conveyer belts for advancing the corrugated blanks through the machine. Typical gluers also include glue applicators that may be mechanically driven along a portion of the corrugated blank in order to apply glue to the glue tab. Additionally, many gluers include means for applying pressure to the glue tab, such as a pneumatic arm, in order to facilitate bonding of the glue to the glue tab and the opposing panel. Because of the complex nature of typical gluing devices and the need to ensure proper timing of the glue dispenser and the other moving parts, gluers often have computers or other electronics that control the operation of the various parts of the machine to prevent the moving parts from colliding with one another.

For example, the computer or other electronics may coordinate the timing and control the operation of one or more pneumatic arms for folding the box blank, a glue applicator for applying glue to the box blanks, and a compression device for applying pressure to the glued portions of the box blank, such that none of these components interferes with the others. The complex nature of these gluers, with the numerous moving parts and electronics, increases the cost of the machines as well as often requiring significant maintenance and operating expenses.

In addition to their relatively complex nature, typical gluers are often very large. A corrugated blank that is glued with a typical gluer is usually folded such that the glue flap extends down the middle of the corrugated blank. Gluers are therefore made with large C-shaped frames. The bottom portion of the frame supports the corrugated blank during the gluing process. The top portion of the frame, which includes the glue applicator, extends over the top of the corrugated blank so as to be able to reach the glue flap in the middle of the corrugated blank. For larger sized corrugated blanks, gluers with even larger sized frames are needed. These large gluing machines can occupy valuable space in a manufacturing or other type of facility.

In another example, taping systems can be used to make a manufacturer's joint. Taping systems include tape dispensers and hand-held tape guns. While these systems may be more space efficient, particularly in comparison to the gluing systems described above, taping devices can be awkward and imprecise for dispensing a length of tape sized for taping a manufacturer's joint. For instance, to create a manufacturer's joint on a box blank using a hand-held taping device requires an individual first to fold and maintain the side panels of the box blank so that the opposing ends of the blank are positioned close together so tape can be applied thereto. The individual must continue to maintain the panels in this position with one hand while using the other hand to grasp the hand-held taping device and applying tape or other sealer to the adjoining areas of the opposing panels. This process can be cumbersome and lead to manufacturer's joints that are weak or otherwise ineffectively secured. While many of the automatic and semi-automatic taping devices are less cumbersome than hand-held devices, like gluer devices, these more sophisticated machines are often complex to use and expensive to manufacture and maintain.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Exemplary embodiments of the invention relate to the manufacture and construction of packaging materials. More particularly, embodiments relate to devices and methods for creating a manufacturer's joint, sealing the manufacturer's joint, closing, and sealing at least one end of the box, such as packaging formed of corrugated board.

In one embodiment, an apparatus for sealing a manufacturer's joint on a box blank and sealing at least one end of the box blank to form a box is disclosed. In one embodiment, the apparatus may include at least a first arm and a spaced apart second arm. The first and second arms may be spaced apart such that at least one end flap of a box blank can be inserted and maintained in a desired position therebetween. The second arm may be configured for securing or maintaining at least two side panels of the box blank in an adjacent position. In one embodiment, the apparatus may further include a support structure, such as a table or a similar planar or substantially planar structure. In one embodiment, the first and second arms may be linked to the support structure.

In one embodiment, the apparatus may further include a taping apparatus configured to dispense an adhesive tape for taping the manufacturer's joint and/or sealing one end of the box. The taping apparatus may include a water activated tape dispenser. The tape dispenser may be operably coupled to a means for measuring the length of at least one tapable surface on an object to be taped, such as the manufacturer's joint.

In one embodiment, a method for assembling a box is described. The method can include (1) providing a box blank having a plurality of side-by-side panels and end flaps coupled to each of the side-by-side panels, (2) providing a sealing apparatus, (3) arranging the box blank so that two opposing side panels are positioned adjacent to each other so as to form a joint when tape is applied thereto, (4) inserting the box blank into the sealing apparatus such that a first end flap in between first and second arms of the apparatus so as to maintain the first end flap in a desired position while the second arm maintains the two opposing side panels adjacent to one another while tape is applied thereto, (5) measuring a length of tape sized for sealing the joint, and (6) sealing the joint to maintain the joint in the adjoined position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Exemplary embodiments of the invention relate to the manufacture and construction of packaging materials. More particularly, the embodiments described herein extend to methods, devices, systems, assemblies, and apparatuses for sealing a manufacturer's joint on a box template and/or sealing one or more of the ends of a box formed using the box template. Such methods, devices, systems, assemblies, and apparatuses are adapted to, for example, reliably form, close, and seal the manufacturer's joint and/or the ends of a box in a simplified manner without the need for complex, expensive, cumbersome, awkward, or space consuming machinery.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present invention. It will be clear, however, to one of ordinary skill in the art that the present invention may be practiced without these specific details. In other cases, well known aspects of closing and sealing objects, general manufacturing techniques, and packaging products are not described in detail herein in order to avoid unnecessarily obscuring the novel aspects of the present invention.

FIGS. 1-9 and the following discussion are intended to provide a brief general description of exemplary devices and methods in which embodiments of the invention may be implemented. While methods, devices, systems, assemblies, and apparatuses for erecting, closing, and sealing a manufacturer's joint and/or the ends of a box are described below, these are but a few examples, and embodiments of the invention may be implemented with other types of closable objects.

The Figures thus illustrate various examples of suitable devices for implementing some aspects of the present invention. The devices in the Figures are only examples of suitable devices/systems and are not intended to suggest any limitation as to the scope of use or functionality of an embodiment of the invention. Neither should the devices/systems be interpreted as having any dependency or requirement relating to any one or combination of components illustrated in the systems/devices.

Figure 1:
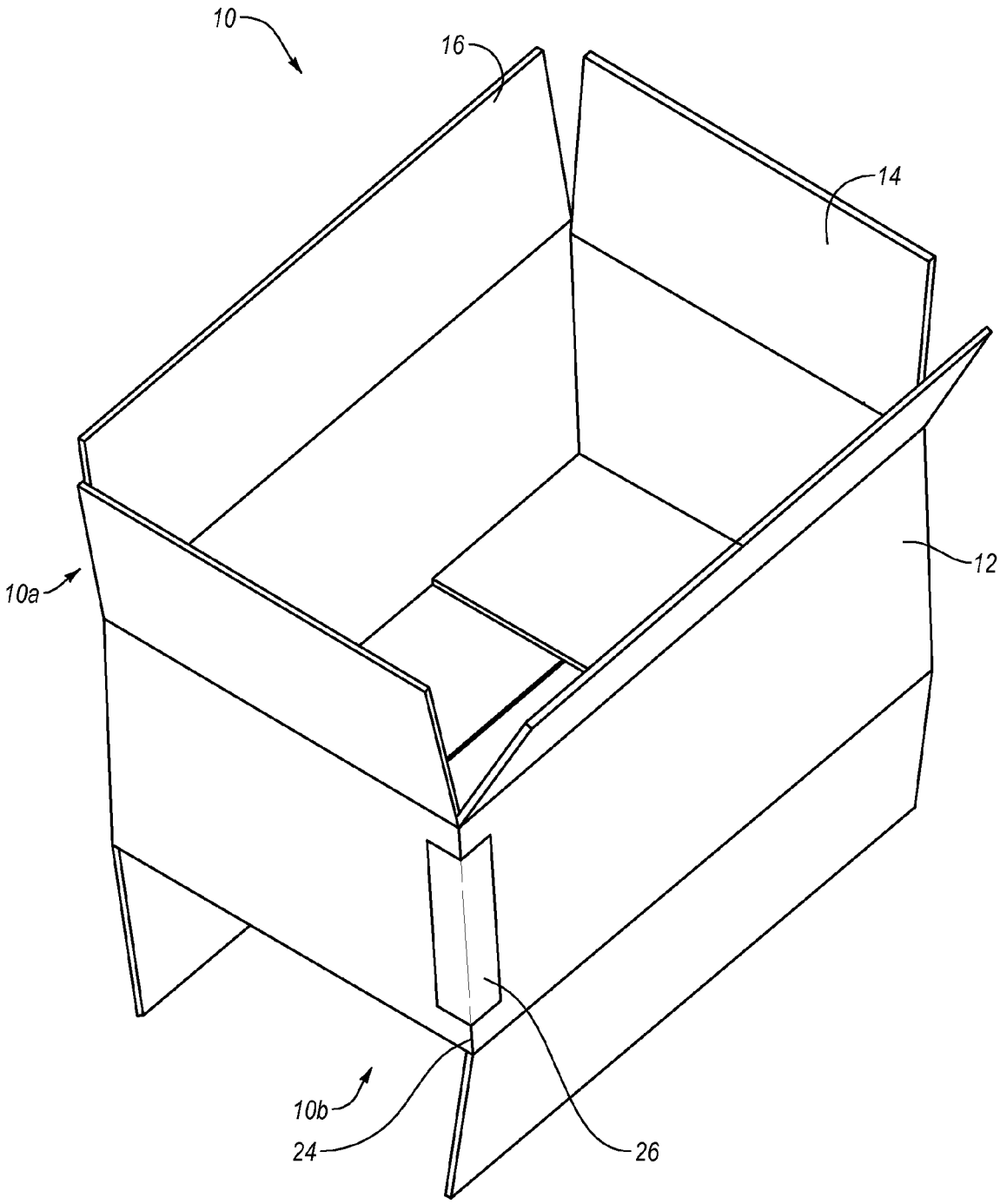
FIG. 1 illustrates a corrugated box.

With reference to FIG. 1, an example of a slotted carton 10 (i.e., a corrugated box) is illustrated. The slotted carton 10 is generally rectangular and includes four contiguous vertical side panels 12 and two pairs of flaps 14, 16, commonly known as the minor 14 and major 16 pairs of flaps, on both the top 10*a* and bottom 10*b* of the box. Each of the flaps 14, 16 is connected to one of the vertical side panels 12.

In one example, a box blank that can be used to form box 10 may be formed from a roll or fanfold of corrugated board. A typical machine may, for example, take an initial roll or fanfold of corrugated board and cut the board into a desired shape and design that includes cuts, scores, perforations, creases, or other features. To ease shipment and storage of the packaging materials, it has been found useful to stack the packaging until such time as it is needed for use or for shipment to an end-user.

A box blank may be formed into a box (e.g., box 10) by folding the blank and joining (e.g., by taping or gluing) opposing vertical side panels 12 together to form the box shape illustrate in FIG. 1. The top and bottom 10*a*, 10*b* are formed by folding the pairs of minor flaps 14 and major flaps 16 toward each other and toward the center of the box 10 and taping or gluing the edges of major flaps 16 together, effectively creating the top and bottom horizontal surfaces of box 10 and closing box 10.

Flaps 14 and 16 on the regular slotted carton 10 are typically sealed in place by glue or by tape. For example, glue can be applied to minor flaps 14 in regions that adjoin major flaps 16 when major flaps 16 are folded onto minor flaps 14. In the case of taping, the tape is often applied to the outside of box 10 in either a "C-clip" or "L-clip" configuration, both of which are commonly known in the art and are described below.

The C-clip is so named because a cross-section of the tape is in the shape of the letter "C." More specifically, a C-clip of tape is a continuous length of adhesive tape that is applied to a portion of one vertical side of a box, across the center of one of the horizontal surfaces of the box to seal the abutting major flaps together, and finally to a portion of the opposite vertical side of the box. Moreover, the tape for a C-clip is typically wide enough to be applied along the abutting flaps such that each of the major pairs of flaps on the top and bottom of the box can be sealed by a single piece of tape. When the regular slotted carton is closed and sealed with a C-clip of adhesive tape, there are no substantial gaps to allow contaminants to reach the product or products enclosed in the box.

The L-clip is so named because a cross-section of the tape is in the shape of the capital letter "L." More specifically, an L-clip of adhesive tape comprises a length of adhesive tape that is applied to a portion of one vertical side of the box and to an adjacent portion of one of the horizontal surfaces of the box, effectively securing one or both of the abutting flaps of the horizontal surface to the vertical side of the box. The number of L-clips applied to a single box can vary based on the manufacturer's or supplier's requirements for the integrity of the box in its sealed condition.

The general application of lengths of box sealing tape to boxes in a C-clip, L-clip, or other configuration by various apparatuses such as hand-held devices and automatic and semi-automatic box sealing machines is well known. However, to close and seal a box using a hand-held device requires an individual first to fold and maintain the minor flaps in position while the major flaps are folded into position. The individual must continue to maintain the flaps in the closed position with one hand while using the other hand to grasp the hand-held device and apply tape or other sealer to the flaps. This process can be cumbersome and lead to boxes being ineffectively closed and/or sealed. While many of the automatic and semi-automatic box sealing machines are less cumbersome than hand-held devices, these more sophisticated machines are often complex to use and expensive to manufacture and maintain.

Figure 2:
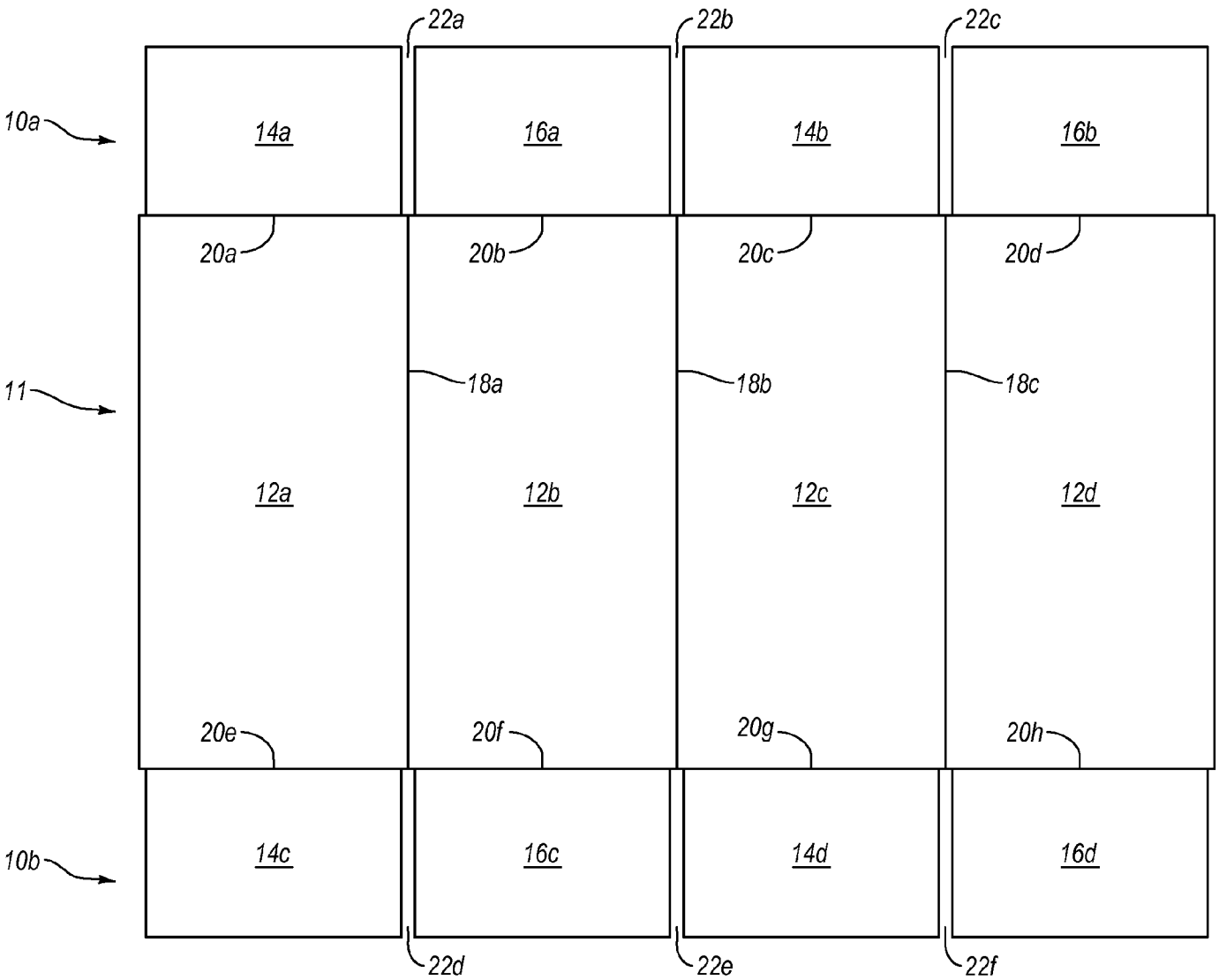
FIG. 2 illustrates a corrugated box blank used to form a corrugated box similar to the box of FIG. 1.

Referring now to FIG. 2, an example of a corrugated box blank 11 is illustrated that can be erected to form box 10 as described herein. Box blank 11 includes four side-by-side panels 12*a*-12*d*. Side-by-side panels 12*a*-12*d* are separated by longitudinal creases 18*a*-18*c*. Additionally, panels 12*a*-12*d* include transverse score lines 20*a*-20*h* and slots 22*a*-22*f* that define opposing flaps 14*a*-14*d* and 16*a*-16*d*. Opposing flaps 14*a*-14*d* and 16*a*-16*d* may be folded to create the top and bottom portions of box 10. Side-by-side panels 12*a*-12*d*, opposing flaps 14*a*-14*d* and 16*a*-16*d*, longitudinal and transverse creases 18*a*-18*c* and 20*a*-20*h*, and slots 22*a*-22*f* can be formed with a creasing/slotting unit and/or a die cutter unit.

Figure 3:
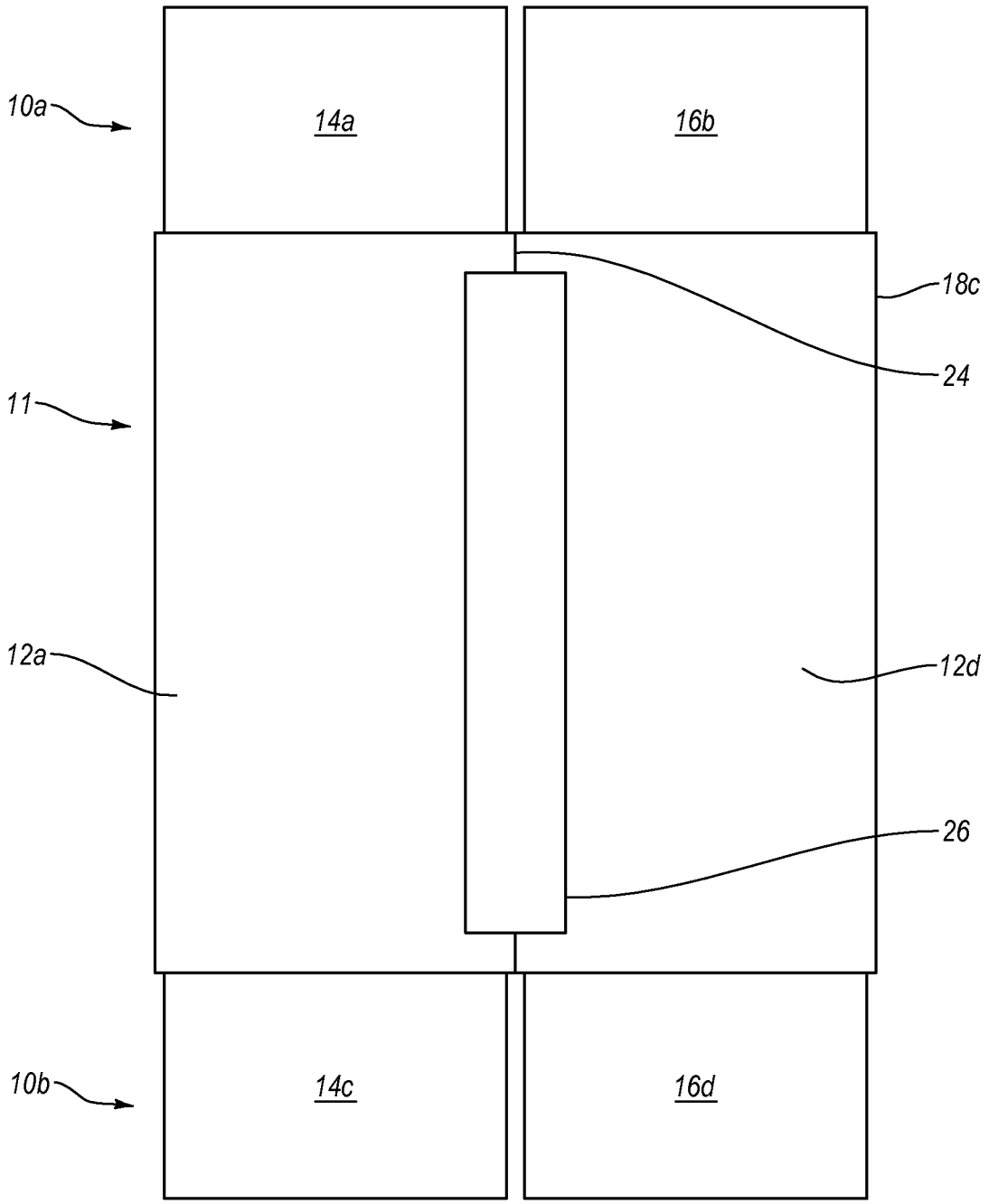
FIG. 3 illustrates the corrugated box blank of FIG. 2 having a sealed manufacturer's joint.

With longitudinal and transverse creases 18*a*-18*c* and 20*a*-20*h* and slots 22*a*-22*f* formed in box blank 11, box blank 11 can be folded along the crease lines 18*a* and 18*c* as shown in FIG. 3, which arranges side panels 12*a* and 12*d* adjacent to one another. Arranging panels 12*a* and 12*d* in this manner forms a butt joint 24, which is commonly referred to as a "manufacturer's joint," between panels 12*a* and 12*d*. Manufacturer's joint 24 can be sealed with an appropriately sized length of tape 26 or another adhesive strip to form box 10, as illustrated in FIG. 1. It is notable that while other taping systems may be used to form a manufacturer's joint (e.g., a tape gun), such systems can be cumbersome to use and the user is not always assured of dispensing tape properly or desirably sized for sealing the manufacturer's joint on the box.

Figure 4:
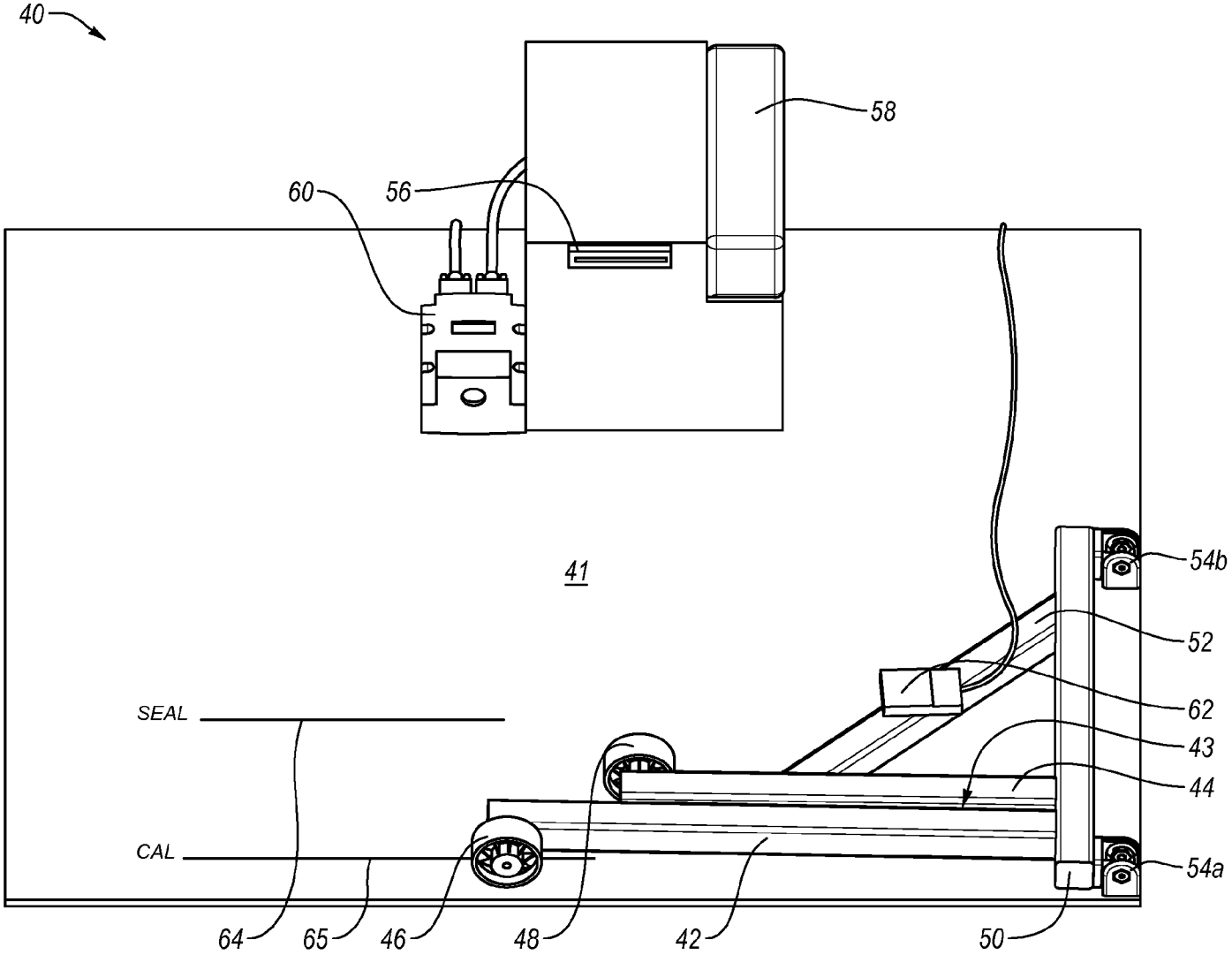
FIG. 4 illustrates a system for sealing a manufacturer's joint in a box blank and sealing the ends of a box formed with the box blank.
Figure 5:
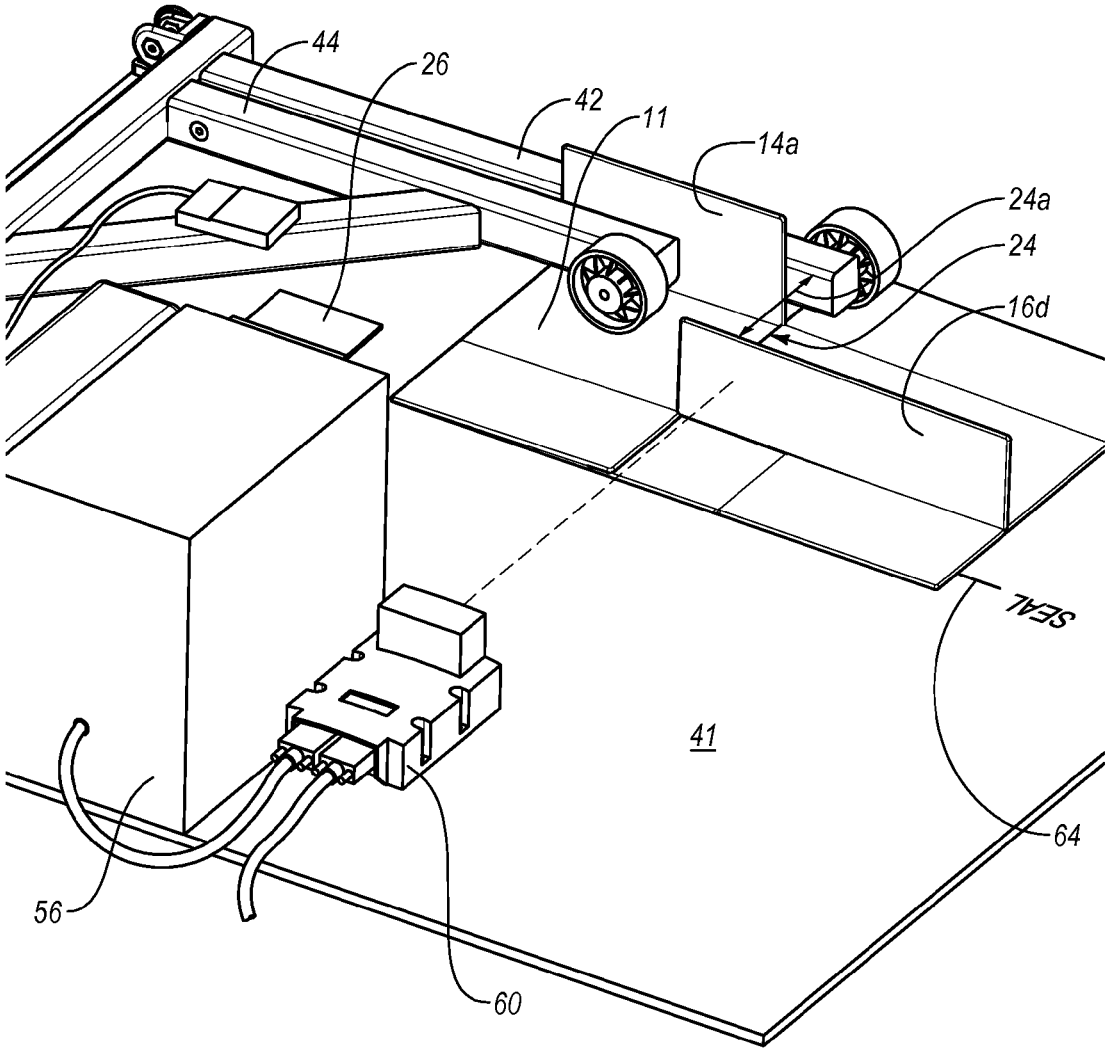
FIGS. 5-6 illustrate steps in the forming of a manufacturer's joint in a box blank using the system of FIG. 4.

Referring now to FIGS. 4 and 5, illustrated is a system 40 for sealing a box blank to form a box. In one embodiment, system 40 includes a support structure 41 and at least a first arm 42 and a second arm 44. In one embodiment, first and second arms 42, 44 may be linked to support structure 41. In one embodiment, support structure 41 is a table. However, other support structures are envisioned within the scope of the claims.

System 40 further includes a space 43 between first and second arms 42, 44. In one embodiment, a flap disposed on a first end of a box blank can be lifted up to an approximately 90° angle and inserted into space 43. This secures and maintains the end of the box blank against first arm 42 for accurately measuring the length of the manufacturers joint as discussed in greater detail below.

Still referring to FIGS. 4 and 5, first and second arms 42, 44 further include first and second wheels 46, 48 or other sliding means disposed on the ends of first and second arms 42, 44 to facilitate insertion of a box blank under first and/or second arms 42, 44. In another embodiment, first and second wheels 46, 48 can be omitted entirely. In one embodiment, first and second arms 42, 44 may further include a pivot arm 50 that may facilitate insertion of a portion of the box blank, such as one or more of the end flaps, under first arm 42. System 40 may also include a bracing arm 52 that extends between pivot arm 50 and second arm 44 to assist in maintaining the desired position and orientation of second arm 44 and/or maintaining the spacing between first and second arms 42, 44.

In one embodiment, system 40 may further include first and second end brackets 54*a*, 54*b* that can be used to secure first and second arms 42 and 44 and/or pivot arm 50 to support structure 41. Either or both of first arm 42 and second arm 44 can be pivotably attached to pivot arm 50. Furthermore, pivot arm 50 can be pivotably coupled to support structure 41 via first and second end brackets 54*a*, 54*b*. In the illustrated embodiment, pivot arm 50 is secured to support structure 41 with first and second brackets 54*a*, 54*b*, which may be bolted or clamped to support surface 41. However, one will appreciate that other appropriate means can be used to secure first and second arms 42, 44 and/or pivot arm 50 to support surface 41. For example, first and second arms 42, 44 can be attached directly to support structure 41 rather than attaching first and second arms 42 and 44 to pivot arm 50.

In one embodiment, system 40 also includes a taping apparatus 56 that is configured to dispense an adhesive tape for taping a box. In the illustrated embodiment, taping apparatus 56 is a water activated tape dispenser. Water activated tape dispenser 56 includes a water reservoir 58 and a roll or other supply of a water-activated adhesive strip (not shown). For example, water activated tape dispenser 56 is configured to dispense a selected length of a moistened adhesive strip when called upon to do so. The selected length of the moistened adhesive strip can then be applied to one or more surfaces of a box to seal, for example, the manufacturer's joint, either end, or both ends of the box.

In one embodiment, tape dispenser 56 may be operably coupled to a means for measuring a length of at least one tapable surface on the box. The measuring means can, for example, instruct the tape dispenser to dispense a length of tape sized for sealing a selected surface of the box. Suitable examples of means for measuring the length of at least one tapable surface include, but are not limited to, an optical sensor, an ultrasonic sensor, an automated box cutting apparatus, a camera, and combinations thereof.

In the illustrated example, the means for measuring the length of the at least one tapable surface of the box includes an ultrasonic sensor 60. In the illustrated example, ultrasonic sensor 60, first arm 42, and second arm 44 are situated and sensor 60 is calibrated such that sensor 60 measures the length of the manufacturer's joint or an end of box 10. Sensor 60 can then direct tape dispenser 56 to dispense a piece of tape having that length either automatically or when an operator depresses a switch (e.g., switch 62).

In the illustrated example, an edge of first arm 42 or gap 43 may act as a reference point, illustrated by calibration line 65. If an object, such as a flap from box template 11, is placed in gap 43 (e.g., between first and second arms 42, 44), sensor 60 will direct dispenser 56 to dispense a length of tape that is sized as a function of the distance between a portion of the object and the reference point. For instance, sensor 60 can detect the position of a portion of the object relative to the reference point, and determine the distance therebetween. Sensor 60 can then direct dispenser 56 to dispense a length of tape that is approximately equal to the determined distance. In one embodiment, support structure 41 can also include at least one indicia (e.g., line 64) for measuring a length of tape for sealing the ends of a box.

Figure 6:
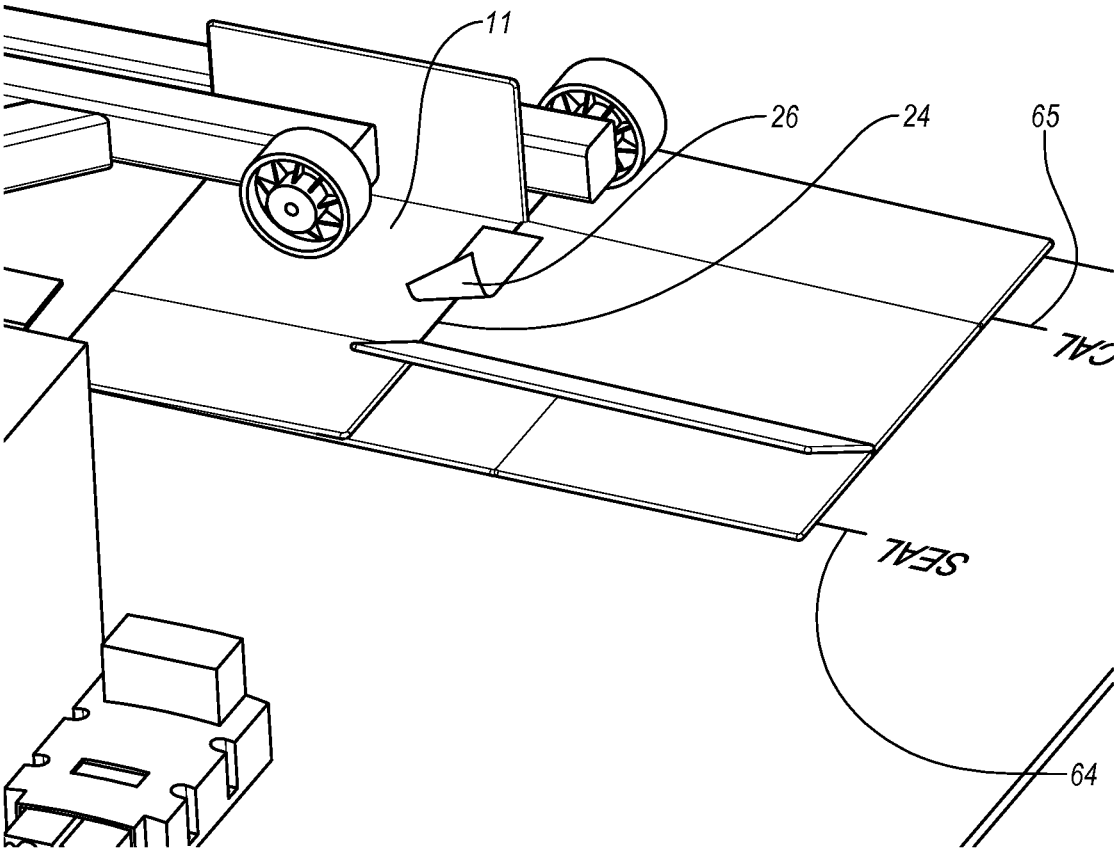
Figure 7:
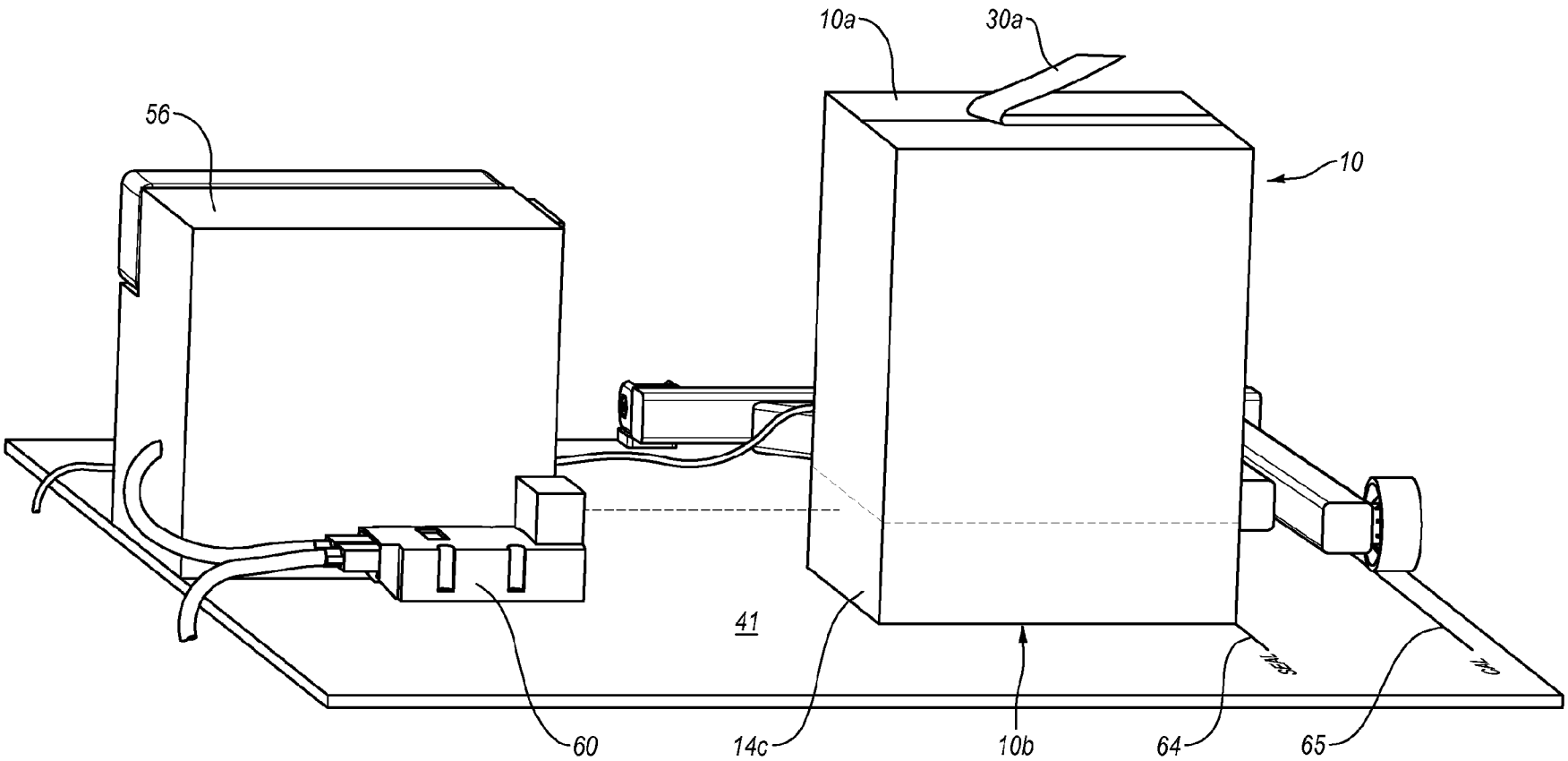
FIG. 7 illustrates the sealing of a first end of a box using the system of FIG. 4.

With reference to FIGS. 5-7, the steps in folding a box blank 11, measuring the length of a manufacturer's joint 24, dispensing a length of tape 26 sized for sealing manufacturer's joint 24, sealing manufacturer's joint 24, and sealing the ends of box 10 are now discussed in more detail. FIG. 5 illustrates a folded box blank 11. First and second arms 42, 44 may be used to secure and/or maintain box blank 11 in the folded position for measuring a length of adhesive tape 26 that is sized for sealing manufacturer's joint 24.

Box blank 11, as illustrated in FIG. 5, is folded along crease lines 18*a*, 18*c* to form manufacturer's or butt joint 24 described above and illustrated in FIG. 3. With box blank 11 folded in this manner, a first end flap 14*a* and an oppositely disposed end flap 16*d* can be folded up to an approximately 90° angle.

Once folded up, end flap 14*a* of box blank 11 can be inserted into gap 43 between first and second arms 42, 44. When end flap 14*a* is inserted in gap 43, first and second arms 42, 43 may securely hold box blank 11 in the folded position shown in FIGS. 5 and 6. That is, first and second arms 42, 44 may be configured for securing at least two side panels (e.g., 12*a*, 12*d*) of box template 11 in an adjacent position to maintain the positioning of manufacturer's joint 24 for sealing. More specifically, first arm 42 can rest upon flap 16*b*, thereby holding panel 12*d* in place on top of panel 12*c*. Similarly, second arm 44 can rest upon panel 12*a*, thereby holding panel 12*a* in place on top of panel 12*b*. With box blank 11 so positioned under first and second arms 42, 44, panels 12*a*, 12*d* are held in place adjacent one another so as to form manufacturer's joint 24. Thus, inserting end flap 14*a* between first and second arms 42, 44 squares box blank 11 relative to first and second arms 42, 44 and positions box blank 11 so that sensor 60 can properly measure the length of manufacturer's joint 24.

As noted, the oppositely disposed end flap 16*d* is raised to an approximately 90° angle in order to block sensor 60's view of first arm 42 (or flap 14*a*). In other words, sensor 60 will "see" end flap 16*d* and be able to calculate the distance between end flap 16*d* and calibration line 65. The distance 24*a* between end flap 16*d* and calibration line 65 as calculated by sensor 60 will be substantially equal to the length of manufacturer's joint 24. As such, sensor 60 can direct tape dispenser 56 to measure a length of tape 26 having a length sized in proportion to the distance 24*a* between end flap 16*d* and first arm 42 (or flap 14*a*) such that a piece of tape 26 is dispensed having an appropriate size (i.e., not too long and not too short) for sealing manufacturer's joint 24.

Referring now to FIG. 6, a piece of tape 26 sized for sealing manufacturer's joint 24 is dispensed and can be used to seal manufacturer's joint 24. More specifically, once box blank 11 is inserted between first and second arms 42, 44 with opposing end flaps 14*a*, 16*d* folded up, the operator presses switch or button 62 which causes sensor 60 to measure distance 24*a* (see FIG. 5) in the manner described herein. Once sensor 60 has measured distance 24*a*, tape dispenser 56 dispenses a length of tape 26 that is generally the length of distance 24*a*. The operator can then apply tape 26 to the manufacturer's joint 24 to seal panels 12*a*, 12*d* together, as shown in FIG. 6.

Because system 40 measures the distance between first arm 42 and oppositely disposed end flap 16*d*, system 40 can be used to measure the length of a manufacturer's joint 24 having a variety of sizes without having to recalibrate system 40. That is, for example, system 40 can be used to assemble and seal a variety of custom-made boxes for packaging a variety of goods without having to recalibrate system 40. Moreover, because system 40 assures that an appropriately sized piece of tape 26 is dispensed regardless of the size of box 10, system 40 is easier to use and less cumbersome than other semi-automated or manual tape dispensing systems (e.g., a tape gun).

Referring now to FIG. 7, box blank 11 can be removed from first and second arms 42, 44 and erected for sealing a first end 10*a* of box 10. In the illustrated example, box 10 can be placed on end 10*b* and aligned with line or indicia 64 on support structure 41. With box 10 so aligned, a piece of tape 30*a* having a length for sealing first end 10*a* of box 10 can be dispensed and used to seal first end 10*a* of box 10, as is illustrated in FIG. 7. It will be noted that line or indicia 64 is spaced apart from calibration line 65. The spacing between line 64 and calibration line 65 causes sensor 60 to measure a length for tape 30*a* that is longer the length of the joint created between end flaps 16*a*, 16*b*. Specifically, sensor 60 will "see" flap 14*c*, measure the distance between flap 14*c* and calibration line 65, and cause tape dispenser 56 to dispense a length of tape 30*a* that can extend across first end 10*a* and onto opposing side panels 12 to seal first end 10*a*. Once first end 10*a* has been sealed, box 10 can then be flipped over and filled with a product via open end 10*b*. Once filled, end 10*b* can be folded closed and box 10 can be realigned with line or indicia 64. End 10*b* can then be sealed with another length of tape 30*a* in a manner similar to that described for sealing end 10*a*.

In light of the above, one embodiment of the present invention includes a method for assembling a box. The method can include (1) providing a box blank 11 having a plurality of side-by-side panels 12*a*-12*d* and end flaps 14*a*-14*d*, 16*a*-16*d* coupled to or extending from side-by-side panels 12*a*-12*d*, (2) providing a sealing system 40, (3) arranging box blank 11 so that two opposing side panels 12*a*, 12*d* are positioned adjacent to each other so as to form a joint 24 to which tape can be applied, (4) inserting box blank 11 into sealing system 40 such that a first end flap 14*a* is between first and second arms 42, 44 of system 40 so as to maintain first end flap 14*a* in a desired position while second arm 44 maintains the two opposing side panels 12*a*, 12*d* adjacent to one another while tape is applied thereto, (5) measuring a length of tape sized for sealing joint 24, and (6) sealing joint 24 to maintain panels 12*a*, 12*d* adjacent one another.

As such, in one aspect, an operator may dispense a length of tape properly or desirably sized for taping manufacturer's joint 24 of box 10 by first folding box blank 11 so that opposing panels 12*a*, 12*d* of box blank 11 are positioned adjacent to one another, as illustrated in FIGS. 3 and 5. As can be seen in FIG. 5, both opposing end flaps 14*a* and 16*d* can be folded to a generally vertical orientation. End flaps 14*a*, 16*d* can be folded before, after, or at the same time panels 12*a*, 12*d* are folded toward each other. Because many boxes are formed from fanfold material, as explained elsewhere herein, and fanfold material includes creases that are not necessarily folding creases for box 10, folding both opposing end flaps 14*a* and 16*d* simultaneously can be advantageous in that it prevents side panels 12*a*, 12*d* from folding along the fanfold creases and facilitates positioning of the opposing panels 12*a*, 12*d* into an adjacent position for sealing.

After folding box blank 11, at least one of the folded end flaps (e.g., 14*a*) is inserted into the apparatus. Specifically, box blank 11 is inserted into the apparatus such that folded end flap 14*a* is inserted between first and second arms 42, 44, as shown in FIGS. 5 and 6. When folded end flap 14*a* is inserted between first and second arms 42, 44, at least of portion of box blank 11, including two folded opposing side panels 12*a*, 12*b*, are inserted and positioned under second arm 44. Second arm 44 secures box blank 11 in the folded position and insertion of folded end flap 14*a* between arms 42, 44 secures the end of the box template 11 (e.g., the portion of box template 11 adjacent crease 20*a*) against first arm 42 (i.e., the end of the box is secured against the zero reference point). In order to measure the length of manufacturer's joint 24, the operator may then raise one of the opposite end flaps (e.g., flap 16*d*) to an approximately 90° angle, as shown in FIG. 5. This blocks the sensor's view of first arm 42 (or calibration line or point 65) and, as explained above, measures the length of manufacturer's joint 24 as a function of the distance between the two folded end flaps 14*a*, 16*d*, or between the opposite folded end flap 16*d* and first arm 42, as shown by arrow 24*a* in FIG. 5. Tape dispenser 56 then automatically dispenses a length of tape 26 or the operator can manually dispense a length of tape 26 that is appropriately sized for sealing manufacturer's joint 24. The operator can then apply length of tape 26 to manufacturer's joint 24 as shown in FIG. 6. End flap 14*a* inserted between arms 42, 44 can serve to define one end of manufacturer's joint 24. As such, end flap 14*a* inserted between arms 42, 44 can serve as a guide for aligning and applying tape 26 to manufacturer's joint 24.

The method described herein can also be used to dispense a length of tape appropriately sized for sealing an end of box 10, as illustrated in FIG. 7. For example, a box 10 having adjoined side panels (e.g., a box having a sealed manufacture's joint as described herein) can be erected and arranged in the shape of a rectangular tube with the end flaps on at least one end closed, as shown in FIG. 7. As shown in FIGS. 4 and 7, support structure 41 includes indicia 64 for measuring a length of tape for sealing the end of box 10. In the case of a box 10 having a square cross-section, any end edge of box 10 can be placed against or aligned with indicia 64, with box 10 extending toward sensor 60, as shown in FIG. 7. Tape dispenser 56 can then automatically dispense a length of tape 26 or the operator can manually dispense a length of tape 26 that is appropriately sized for sealing the end of box 10.

In the illustrated embodiment, indicia 64 is spaced apart from first arm 42 or calibration line 65 so that when sensor 60 "sees" the side of box 10 closest to sensor 60, it will measure a length of tape 26 that is long enough to extend along the entire length of major flaps 16 and over onto the vertical sides 12 of box 10 (e.g., to form a C-clip). In another embodiment, indicia 64 can be spaced from first arm 42 or calibration line 65 so that sensor 60 measures two lengths of tape 26 that can be used to form two L-clips.

Figure 8:
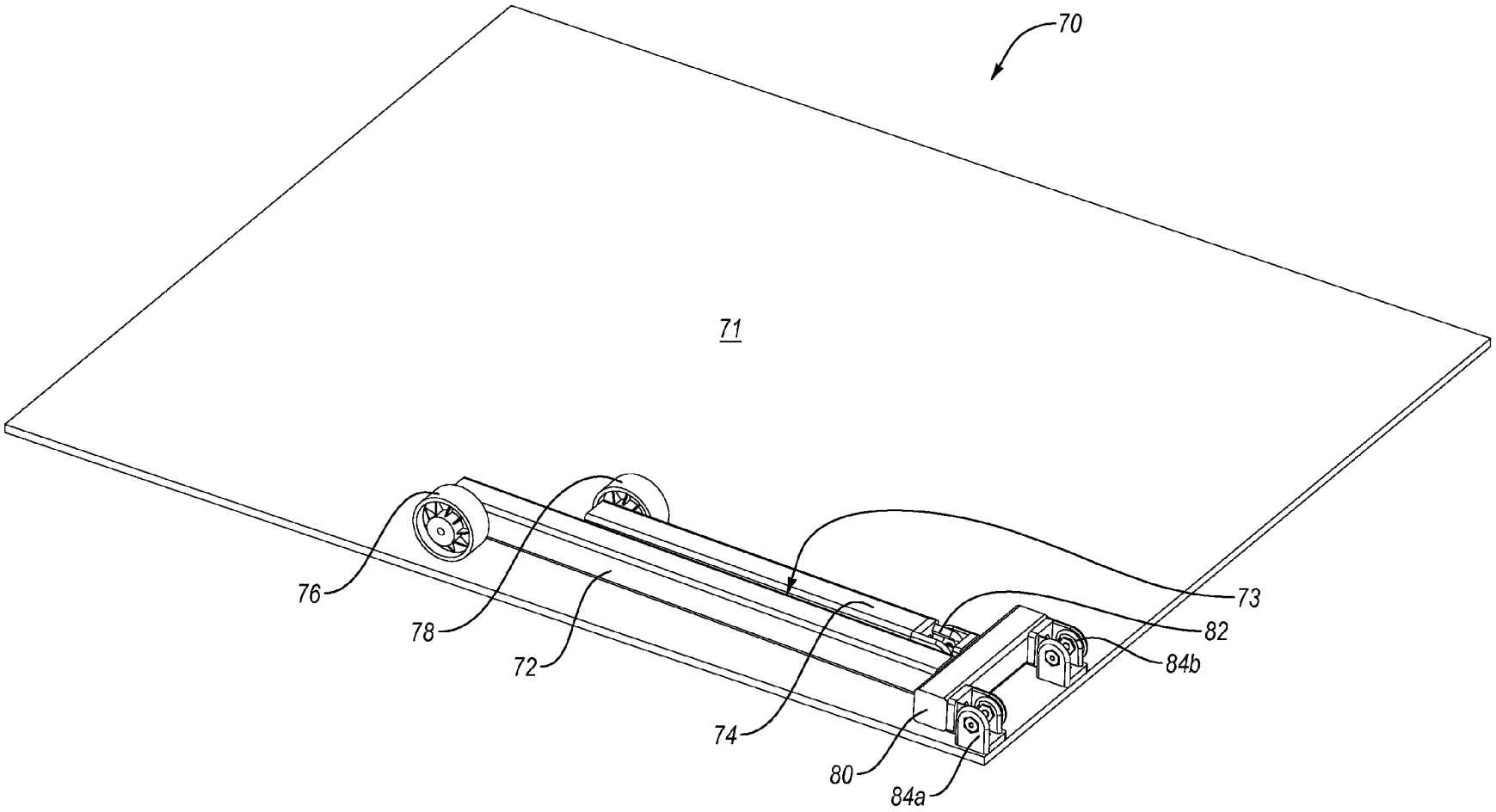
FIGS. 8-9 illustrate an alternative embodiment of an apparatus for creating a manufacturer's joint in a box blank and sealing the ends of a box formed with the box blank.
Figure 9:
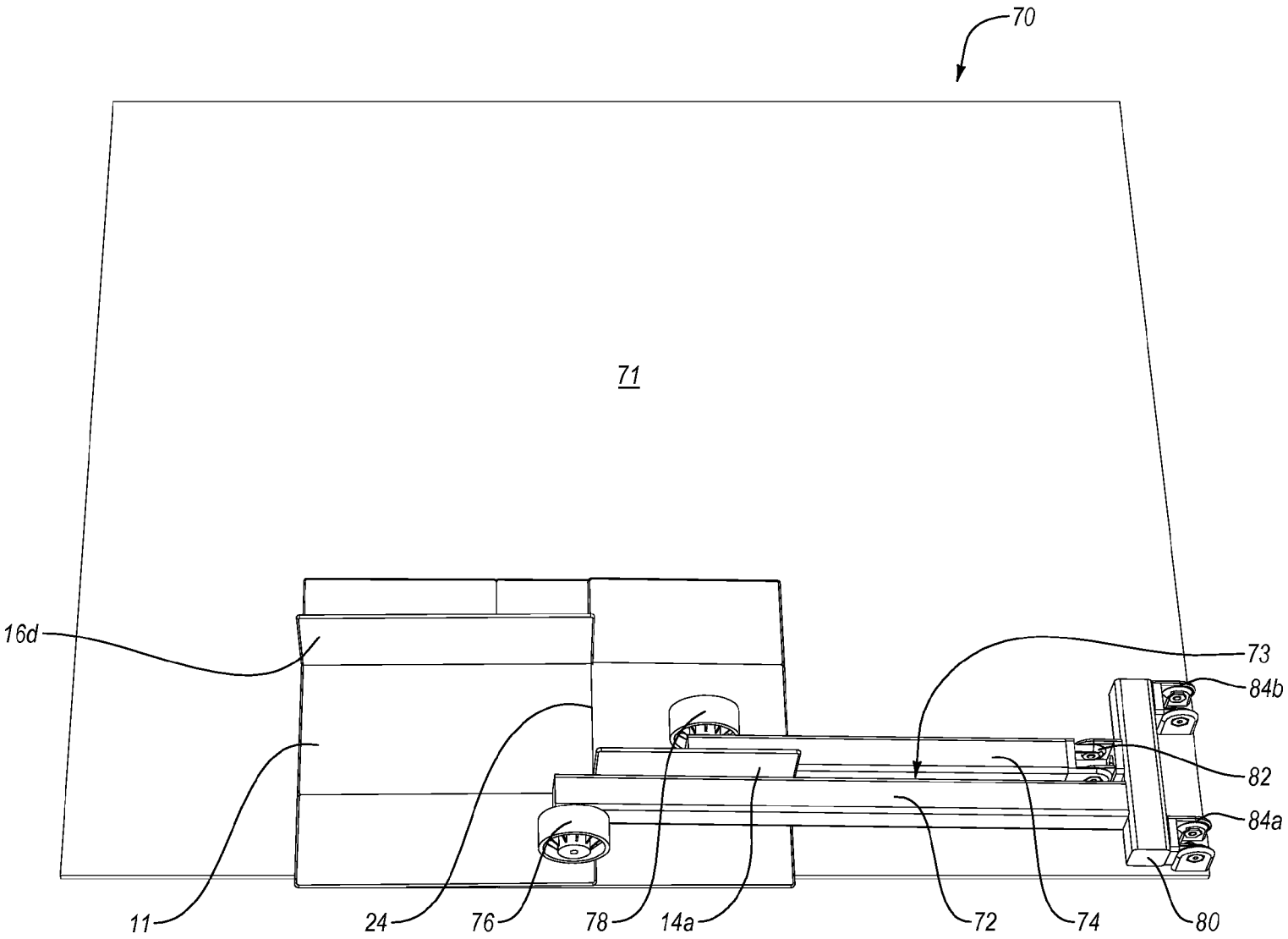

Referring now to FIGS. 8-9, an alternative embodiment of a system 70 for sealing a manufacturer's joint of a box blank 11 and/or the ends of a box 10 is illustrated. In system 70 illustrated in FIGS. 8-9, a taping apparatus and a measurement device are omitted. One will appreciate that these items can be included or left out without departing from the spirit of the present disclosure.

In one embodiment, system 70 includes a support structure 71 and at least a first arm 72 and a second arm 74. In one embodiment, first and second arms 72, 74 may be linked to support structure 71. In one embodiment, support structure 71 is a table. However, other support structures are envisioned within the scope of the claims.

System 70 includes a space 73 between first and second arms 72, 74. In one embodiment, a flap 14*a* disposed on a first end 10*a* of a box blank 11 can be lifted up to an approximately 90° angle and inserted into space 73, as shown in FIG. 9. This secures and maintains the end of box blank 11 (e.g., the areas of box blank 11 adjacent crease 20*a*) against first arm 72 for accurately measuring the length of manufacturer's joint 24 and for guiding and aligning an operator for applying a length of tape to manufacturer's joint 24.

First and second arms 72, 74 further include first and second wheels 76, 78 or other sliding means disposed on the ends of first and second arms 72, 74 to facilitate inserting box blank 11 under first and/or second arms 72, 74. In another embodiment (not shown), first and second wheels 76, 78 can be omitted entirely.

In one embodiment, first and second arms 72, 74 may further include a pivot arm 80 that may facilitate insertion of a portion of box blank 11 under first or second arms 72, 74, such as one or more of end flaps 14 under first arm 72 and/or one or more of panels 12 under second arm 74. Either or both of first arm 72 and second arm 74 can be pivotably attached to pivot arm 80. For example, as shown in FIGS. 8-9, second arm 74 is pivotably attached to pivot arm 80 via bracket 82. In one embodiment, first and second arms 72, 74 may further include first and second end brackets 84*a*, 84*b* that can be used to secure first and second arms 72, 74 and/or pivot arm 80 to support structure 71. However, one will appreciate that other appropriate means can be used to secure first and second arms 72, 74 and/or pivot arm 80 to support surface 71. For example, first and second arms 72, 74 can be attached directly to support structure 71 rather than attaching first and second arms 72, 74 to pivot arm 80.

While the examples shown in the Figures illustrate folding and sealing aids that have rigid arms (e.g., arms 42, 44, 72, 74) attached to the support structure via pivot structures, one will appreciate that other designs are possible. For example, a device could be made with two arms that are rigidly fixed to the support structure. In one example, the arms could be made from leaf springs or another resilient material such that the arms could be biased to rest on the plane of the support structure but also be flexible in the direction perpendicular to the support structure. This would allow the device to be used in a number of orientations while allowing the arms to provide a reference position for measuring a length of tape for sealing the manufacturer's joint. Moreover, the spring-like arms could provide sufficient downward force to keep the box panels from lifting up while the tape is applied but still allow the folded box to be easily inserted and removed from the apparatus. In another example, the arms could be stiff and rigidly attached to the support structure with an appropriate gap to allow the folded box to slide under the arms. In this case, wheels or other sliding means could be disposed at the ends of the arms to provide the downward force to maintain the sides of the box in a folded position for measuring the length of the manufacturer's joint and application of tape to the joint.

As noted above, many typical box assembly devices are configured to glue box blanks that are folded so a glue tab is positioned in the middle of the box blank, thus requiring a large frame that can reach the middle of the box blank in order to apply the glue to the glue tab and press the glue tab against the adjacent panel. The configuration of these large frames makes it more difficult to apply the glue and pressure to the box blanks. Additionally, these large frames occupy significant amounts of valuable space. Furthermore, the large size of typical gluing devices means that the distance and time required of a handler to process a box blank through the various machines (i.e., the box cutting/creasing device, gluing device, etc.) is greater than if the devices were smaller.

In contrast, the devices and apparatuses described herein allow an operator to seal the manufacturer's joint and/or the ends of the box without the need for large and/or complicated machinery. The devices and apparatuses of the present invention are sized and configured to fit within a relatively small area so that they can be placed in close proximity to other box processing devices. This leads to less distance and time required of a handler to process each box. Moreover, the devices and apparatuses described herein are adapted for sealing boxes having a wide variety of sizes without having to recalibrate and/or retool a large and complicated machine. These aspects make the devices, apparatuses, and methods particularly well-suited for manufacturers and shippers that process and box a wide variety of goods having a wide variety of different sizes.

While various features of the present invention have been described and illustrated herein, including a support structure, first and second arms, and a tape dispenser, it will be appreciated that the present invention can be configured with or without these various features. Additionally, the present invention can be configured with any combination of these features without departing from the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for sealing portions of a box blank to form a box, comprising:

a first arm pivotable about a first axis; and a second arm pivotable about a second axis, the second arm being spaced apart from the first arm in a direction that is parallel to at least one of the first axis and the second axis, wherein at least one end flap of a box blank is configured to be inserted into the space between the first arm and the second arm to align a portion of the box blank with the first arm, and at least one of the first arm and the second arm being configured to maintain at least two side panels of the box blank in an adjacent position to form a manufacturer's joint.

2. The apparatus of claim 1, further comprising a support structure, wherein the first and second arms are linked to the support structure and wherein the support structure is configured for supporting the box blank.

3. The apparatus of claim 1, wherein the apparatus is part of a system that includes a tape dispenser configured to dispense an adhesive tape for taping the at least two adjacently positioned side panels of the box blank to form the manufacture's joint.

4. The apparatus of claim 1, wherein at least one of the first arm and the second arm includes a wheel coupled adjacent to an end thereof to facilitate insertion of the box blank under the at least one of the first arm and the second arm.

5. The apparatus of claim 3, wherein the system further includes a means for measuring a length of at least one tapable surface of the box blank, wherein the tape dispenser is operably coupled to the means for measuring a length of at least one tapable surface of the box blank.

6. The apparatus of claim 5, wherein the means for measuring the length of the at least one tapable surface is selected from a group consisting of an optical sensor, an ultrasonic sensor, an automated box cutting apparatus, a camera, and combinations thereof.

7. The apparatus of claim 5, wherein the means for measuring the length of the at least one tapable surface includes an ultrasonic sensor.

8. The apparatus of claim 5, wherein the at least one tapable surface includes a manufacturer's joint for adjoining at least two adjacently positioned side panels of the box blank.

9. The apparatus of claim 8, wherein the first arm or the space between the first arm and the second arm serves as a reference point for measuring the length of the manufacturer's joint using an ultrasonic sensor.

10. The apparatus of claim 5, wherein the at least one tapable surface includes at least two end flaps.

11. The apparatus of claim 10, further comprising a support surface, the first and second arms being linked to the support surface and the support surface being configured for supporting the box blank, the support surface including at least one indicia for measuring a length of tape sized for sealing the at least two end flaps.

12. The apparatus of claim 1, wherein the first axis and the second axis are parallel and offset from one another.

13. The apparatus of claim 1, wherein the first arm is pivotable about both the first axis and the second axis.

14. The apparatus of claim 1, wherein the first axis and the second axis are collinear with one another.

15. The apparatus of claim 1, further comprising a support structure having a support surface for supporting the box blank, the first arm being linked to the support structure and extending a first distance across the support surface, and the second arm being linked to the support structure and extending a second distance across the support surface, the second distance being different than the first distance.

16. A system for sealing portions of a box blank to form a box, comprising:

a support structure having a support surface for supporting the box blank;

a first arm linked to the support structure, the first arm extending a first distance across the support surface;

a second arm linked to the support structure, the second arm extending a second distance across the support surface, the second distance being different than the first distance, the second arm being spaced apart from the first arm, wherein a first end flap of the box blank is configured to be inserted into the space between the first arm and the second arm to align a portion of the box blank relative to the first arm, at least one of the first arm and the second arm being configured to maintain at least two side panels of the box blank in an adjacent position to form a manufacturer's joint; and a tape dispenser configured for dispensing a specific length of tape sized for taping at least a portion of the manufacturer's joint.

17. The system of claim 16, wherein the first arm and the second arm are pivotable about one or more parallel or collinear axes.

18. The system of claim 16, wherein the tape dispenser is operably coupled to a measuring device that is adapted to measure the length of the portion of the manufacture's joint, the measuring device being selected from a group consisting of an optical sensor, an ultrasonic sensor, a box cutting apparatus, a camera, and combinations thereof.

19. The system of claim 18, wherein the measuring device measures a length of a manufacturer's joint between the first end flap and a second opposing end flap.

20. The system of claim 16, wherein the first and second arms are coupled to a pivot arm.

21. The system of claim 16, wherein at least one of the first and second arms is pivotally coupled to the pivot arm.

22. The system of claim 20, wherein the pivot arm is pivotally coupled to the support structure.

23. The system of claim 22, wherein the support structure includes indicia for measuring a length of tape sized for sealing an end of the box.

24. A method for assembling a box, comprising:

providing a box blank having a plurality of side-by-side panels and an end flap extending from each of the side-by-side panels;

providing a sealing apparatus, including:

a support structure;

a first arm pivotally linked to the support structure and extending a first distance across the support structure; and a second arm pivotally linked to the support structure and extending a second distance across the support structure, wherein the first arm and the second arm are spaced apart from each other and a first end flap of the box blank is configured to be folded up and inserted between the first arm and the second arm;

arranging the box so that at least two side panels are positioned adjacent to each other to form at least a portion of a joint;

inserting the box blank into the sealing apparatus with the first end flap between the first arm and the second arm and such that the first arm extends a first distance across the box blank and the second arm extends a second distance across the box blank so that the two adjacently positioned side panels are maintained in a desired position by the first arm and the second arm;

providing a selected length of tape sized for sealing the joint; and sealing the joint with the length of tape.

25. The method of claim 24, wherein providing the selected length of tape sized for sealing the joint includes detecting the length of the joint and directing a tape dispenser to dispense a length of tape sized for sealing the joint.

26. The method of claim 24, further comprising providing a tape dispenser.

27. The method of claim 26, wherein the tape dispenser is linked to a means for measuring a length of the joint.

28. The method of claim 27, wherein the means for measuring the length of the joint includes at least one of an optical sensor, an ultrasonic sensor, a box cutting apparatus, a camera, and combinations thereof.

29. The method of claim 27, further comprising:

folding a second flap to an upward position;

detecting the position of the second flap so as to measure the length of the joint between the first and second flaps; and dispensing a measured length of tape from the tape dispenser; and applying the measured length of tape to the joint.

* * * * *